US008980069B2

(12) United States Patent
Hoyt et al.

(10) Patent No.: US 8,980,069 B2
(45) Date of Patent: Mar. 17, 2015

(54) HIGH TEMPERATURE ELECTROLYSIS CELL REFRACTORY SYSTEM, ELECTROLYSIS CELLS, AND ASSEMBLY METHODS

(75) Inventors: Timothy L. Hoyt, Marysville, OH (US); Christina Bernstein, Hilliard, OH (US); Anthony S. Disaia, Powell, OH (US); Herman Eslick, London, OH (US); Dana G. Goski, Upper Arlington, OH (US)

(73) Assignee: Allied Mineral Products, Inc., Columbus, OH (US)

( * ) Notice: Subject to any disclaimer, the term of this patent is extended or adjusted under 35 U.S.C. 154(b) by 253 days.

(21) Appl. No.: 13/299,019

(22) Filed: Nov. 17, 2011

(65) Prior Publication Data

US 2013/0126339 A1 May 23, 2013

(51) Int. Cl.
*C25C 7/00* (2006.01)

(52) U.S. Cl.
CPC ..... *C25C 7/005* (2013.01)
USPC ..... 204/247.4

(58) Field of Classification Search
CPC ..... C25C 7/005; C25C 3/00–3/36
USPC ..... 204/243.1–247.5; 205/354–412
See application file for complete search history.

(56) References Cited

U.S. PATENT DOCUMENTS 2,856,343 A * 10/1958 Coleman et al. ..... 204/247.5
4,073,703 A * 2/1978 Kinosz et al. ..... 205/404
4,308,116 A 12/1981 Andreassen et al.
4,560,449 A 12/1985 Sivilotti
4,960,501 A * 10/1990 Sivilotti ..... 204/244
5,033,721 A 7/1991 Gnyra
5,137,603 A * 8/1992 Arthur et al. ..... 202/139
5,423,152 A 6/1995 Kolvek
5,429,722 A 7/1995 Cullen
5,565,080 A 10/1996 Peacey et al.
6,358,393 B1 3/2002 Berclaz et al.
6,458,732 B1 10/2002 Doza et al.
6,893,992 B2 5/2005 Doza et al.
7,827,689 B2 11/2010 Crane et al.

FOREIGN PATENT DOCUMENTS

GB 1270660 4/1972
WO 9514119 5/1995

OTHER PUBLICATIONS

Elmtherm Data Sheet (undated, available prior to Nov. 17, 2011).
Elmelec GM 40 SRP Data Sheet (undated, available prior to Nov. 17, 2011).
Ullmann's Encyclopedia of Industrial Chemistry, vol. 22, "Magnesium", pp. 1-26 (2012, available prior to Nov. 17, 2011).

* cited by examiner

*Primary Examiner* — Harry D Wilkins, III
*Assistant Examiner* — Ciel Thomas
(74) *Attorney, Agent, or Firm* — Porter Wright Morris & Arthur LLP

(57) ABSTRACT

A high temperature electrolysis cell refractory system comprises at least one precast and predried monolithic refractory flooring module, precast and predried monolithic refractory wall modules, and at least one precast and predried monolithic refractory ceiling module, wherein the flooring module(s), wall modules and ceiling module(s) are configured for assembly to form a sealable electrolysis cell in which adjacent modules have interlocking surfaces. The refractory system is assembled within a steel containment shell to provide a high temperature electrolysis cell.

20 Claims, 4 Drawing Sheets

HIGH TEMPERATURE ELECTROLYSIS CELL REFRACTORY SYSTEM, ELECTROLYSIS CELLS, AND ASSEMBLY METHODS

FIELD OF THE INVENTION

The present invention relates to high temperature electrolysis cells, for example, for the recovery of metals such as magnesium, lithium, sodium, titanium and the like, from molten salts. More specifically, the present invention relates to high temperature electrolysis cell refractory systems, methods of assembling high temperature electrolysis cells, and high temperature electrolysis cells formed by such methods. The systems, methods and high temperature electrolysis cells facilitate installation and extend useful life of the electrolysis cells and facilitate future repairs.

BACKGROUND OF THE INVENTION

Various metals are produced in elemental form from molten salts in high temperature electrolysis cells. For example, magnesium production via electrolysis cells accounts for more than three quarters of all magnesium produced globally. The typical process involves high temperature molten salt electrolysis of $MgCl_2$ in a cell. The process is operated at sufficiently high temperatures to maintain both the electrolyte and the metal in molten states. The process generates liquid magnesium metal and chlorine gas from the salt bath. The lower density magnesium is transported via the cathode to a metal holding chamber, subsequently rising to the salt bath surface. The resultant chlorine gas is removed in order to prevent reversal of the chemical reaction.

Magnesium electrolysis cells that are used in the industry can be classified as sealed cells or unsealed cells, as described in the Peacey et al U.S. Pat. No. 5,565,080. Sealed cells are considered the more modern processing equipment and are tightly sealed to prevent moisture and air from entering the reaction cell. The presence of moist air results in the formation of MgO which will develop MgO-based build up or sludge on the bottom of the cell or which will react with the graphite anodes to digest the graphite and reduce their life expectancy. These cells are designed to operate for an extended period of time without stopping cell operation, and repair or rebuilding, when necessary, is a costly and time consuming process. Such cells include mulitpolar cells as described in the Sivilotti U.S. Pat. No. 4,560,449 and monopolar cells as described in the Andreassen et al U.S. Pat. No. 4,308,116.

FIG. 1 shows a conventional electrolysis cell 10 which comprises an electrolysis chamber 12 and a collection chamber 14, separated by a partition wall 13. Steel cathodes 16 and graphite anodes 18 are provided in the electrolysis chamber. Molten electrolyte flows through a lower opening in the partition wall to the electrolysis chamber and metal flows from the electrolysis chamber through an upper opening in the partition wall and is removed from the collection chamber through an outlet 20. Gas, e.g., chlorine, is removed from the electrolysis chamber through outlet 22.

Refractories are required in the electrolysis cells, for example, in the magnesium electrolysis salt cells, to thermally insulate the bath contents, to prevent failure of the steel containment shell, and to partition zones within the processing cell. With reference to FIG. 1, typical cell construction employs a steel shell 23 and a refractory lining 24. The refractory lining is in the form of an inner wall 26 of super duty firebricks and is in contact with the molten salt bath. Secondary back-up layers of super duty firebrick between the steel shell and the inner firebrick wall 26 which contacts the molten salt bath are also commonly used to control the thermal gradient within the cell and provide a secondary means of containing the molten salt bath. All of these layers are built with refractory brick and moisture-containing mortar. A layer formed of refractory board is also frequently used on the inside of the cell's steel shell to reduce the amount of heat loss.

Typically, the refractory system of an electrolysis cell is formed by laying-up brick work, as well as field-casting monolithic refractory, for example, for forming subhearths and cathode walls. However, various disadvantages result from such construction. For example, the "man-handable" sized brick and small block used in forming the refractory walls for cell construction do not accommodate gaps in their alignment with the steel sheet of the containment shell. Such gaps are typically filled with the same mortar which is used to assemble the bricks and blocks. The mortar has a higher porosity than the other refractory components and therefore is the weakest point in the refractory system. As such, mortar is the preeminent source for leaks and wear in the refractory system. Additionally, the gaps can result in the refractory lining shifting during operation, causing cracking and opening of mortar joints where the electrolyte can infiltrate. Not only is the integrity of the cell compromised, spent cell removal can be difficult when electrolyte has migrated through the brick lining and solidified en mass.

Additionally, casting of the floors, through walls and other components on site with traditional or modern monolithic refractory requires water. The refractory castable is mixed with water, poured, and allowed to set, which can take a period of 12-24 hours, after which water must be removed. The water in the refractory castable consists of both free water, which will evaporate at 212° F., and chemically-bound water of multiphase calcium aluminate hydrates, which is typically liberated over a range of temperatures up to 1150° F. In order to completely remove water from the system, the furnace must be "baked-out" on site before being placed into service. This process may take up to several weeks, and, in practice, it is difficult to completely remove the chemically-bound water. As such, there may be components of the refractory lining which never completely become dehydrated prior to use and can disadvantageously continue to evolve water in service. Further, the subhearth, floor or walls are large components in the electrolysis cell and may contain between 4.5-7% water. The presence of water in such a large amount can create shrinkage cracks upon curing. Once the floor or wall is installed and cured, if cracks are identified, the component may need to be removed and re-poured. On the other hand, if the water is not removed completely before the cell is put into service, it will react to form MgO during the cell operation, which, as noted previously, reduces the operation life and/or the operating efficiency of the cell.

Accordingly, improvements in electrolysis cell refractory construction are desired in order to provide cells which avoid various disadvantages of the prior art.

SUMMARY OF THE INVENTION

The present invention provides high temperature electrolysis cell refractory systems and high temperature electrolysis cells which overcome various disadvantages of the prior art and facilitate assembly of high temperature electrolysis cells.

In one embodiment, the invention is directed to high temperature electrolysis cell refractory systems which comprise at least one precast and predried monolithic refractory flooring module, precast and predried monolithic refractory wall modules, and at least one precast and predried monolithic refractory ceiling module, wherein the flooring module(s), wall modules and ceiling module(s) are configured for assembly to form a sealable electrolysis cell in which adjacent modules have interlocking surfaces.

In another embodiment, the invention is directed to methods for assembling a high temperature electrolysis cell. The methods comprise (a) providing a steel containment shell, (b) installing a floor of at least one precast and predried monolithic refractory flooring module in the steel containment shell, (c) installing precast and predried monolithic refractory wall modules in the steel containment shell, and (d) installing at least one precast and predried monolithic refractory ceiling module in the steel containment shell, wherein adjacent modules have interlocking surfaces and wherein the flooring modules, wall modules and ceiling modules form a sealable electrolysis cell.

In yet another embodiment, the invention is directed to high temperature electrolysis cells which comprise (a) a steel containment shell, (b) a floor of at least one precast and predried monolithic refractory flooring module arranged in the steel containment shell, (c) precast and predried monolithic refractory wall modules arranged in the steel containment shell, and (d) at least one precast and predried monolithic refractory ceiling module arranged in the steel containment shell, wherein adjacent modules have interlocking surfaces, and wherein the flooring modules, wall modules and ceiling modules form a sealable electrolysis cell.

The refractory systems, methods and high temperature electrolysis cells of the invention are advantageous in facilitating installation and extending the useful life of the electrolysis cells and facilitating future repairs. Additional embodiments and advantages of the invention will be apparent in view of the following detailed description.

BRIEF DESCRIPTION OF THE DRAWINGS

The detailed description will be more fully understood when viewed together with the drawings, in which.

DETAILED DESCRIPTION

Figure 1:
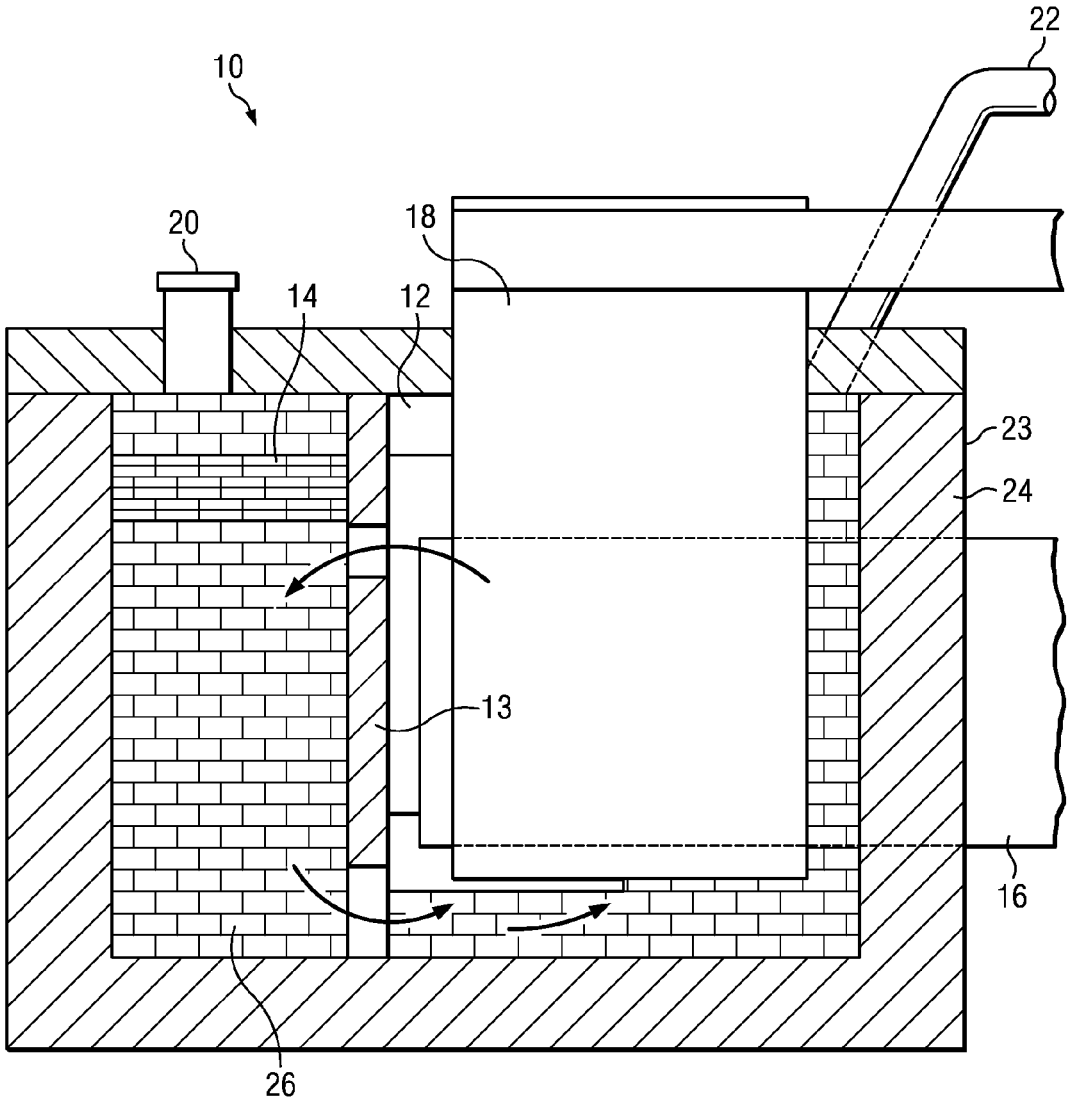
FIG. 1 PRIOR ART
FIG. 1 shows a schematic view of a conventional electrolysis cell construction, including a lining formed of refractory bricks.
Figure 2:
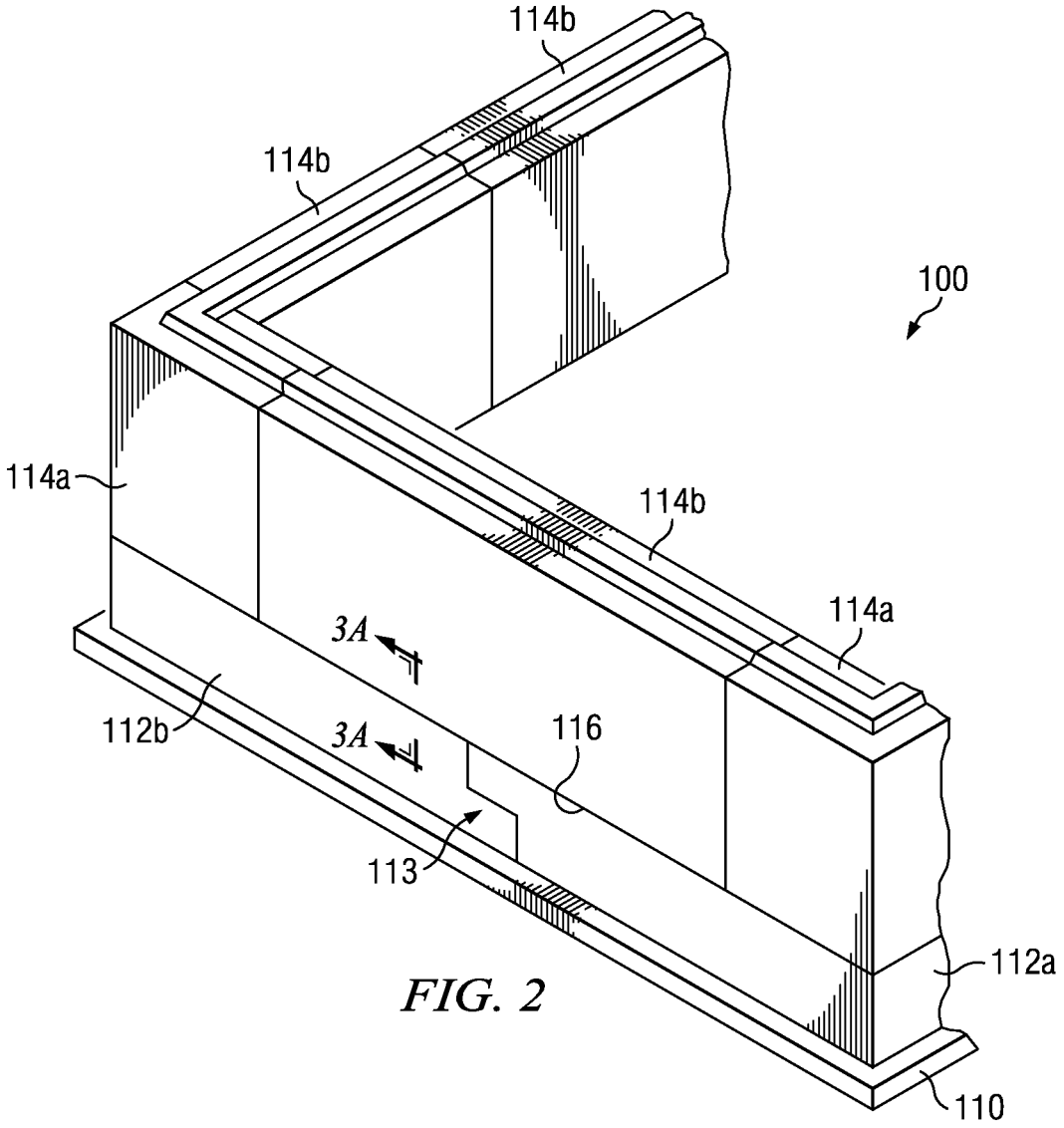
FIG. 2 shows a schematic view of one embodiment of an interlocking construction for adjacent floor and wall module surfaces according to the present invention.

The refractory systems, methods and electrolysis cells of the invention facilitate construction of a robust refractory system and electrolysis cell which avoid various disadvantages of the prior art.

In a first embodiment, the high temperature electrolysis cell refractory system comprises at least one precast and predried monolithic refractory flooring module, precast and predried monolithic refractory wall modules, and at least one precast and predried monolithic refractory ceiling module. The flooring module(s), wall modules and ceiling module(s) are configured for assembly to form a sealable electrolysis cell in which adjacent modules have interlocking surfaces. That is, the modules are configured such that they will form an electrolysis cell that is sealed to essentially prevent entry of water or air during operation of the electrolysis cell. One skilled in the art will appreciate that it is customary for an electrolysis cell structure to include one or more openings through which electrodes, i.e., anodes and/or cathodes, extend upon installation. Therefore, reference herein to a sealed cell refers to the cell once such electrodes are installed. Thus, one or more modules of the high temperature electrolysis cell refractory system may be configured to provide the electrolysis cell with openings for receiving cathodes.

Modules may be sized and shaped according to the size and shape of the electrolysis cell. Typically, the modules will have two opposing generally rectangular planar surfaces, as shown in the figures. In one embodiment, each wall (side) module may have surface dimensions of from at least about two feet by about two feet. In a specific embodiment, each wall module has surface dimensions of from at least about three feet by about two and one half to about three feet and weighs at least about 2000 pounds. One skilled in the art will appreciate therefore that a single module may replace a substantial number of refractory bricks used in conventional electrolysis cell construction. In a specific embodiment, the refractory system comprises two to four flooring modules. In a more specific embodiment, two or four flooring modules, each having surface dimensions of at least 5 feet by 5 feet and weighing about 5000 pounds, up to about 5 feet by about 12 feet and weighing about 10,000 pounds are employed. In another embodiment, the wall modules comprise lower wall modules which have lower surfaces adjacent to and interlocking with the floor module(s), and upper wall modules. The lower wall modules and the upper wall modules have adjacent and interlocking surfaces. In one embodiment, the upper wall modules have upper surfaces adjacent to and interlocking with the ceiling module(s). In another embodiment, the upper wall modules have upper surfaces adjacent to and interlocking with a second row of upper wall modules. Additional rows of upper wall modules may be provided as necessary to obtain the desired height of the electrolysis cell, with the uppermost upper wall modules have upper surfaces adjacent to and interlocking with the ceiling module(s).

The modules employed in the refractory system of the invention are advantageous over conventional refractory brick in that the amount of mortar required to assemble the modules is significantly reduced as compared with that required for conventional laying-up of refractory brick linings. Thus, the susceptibility of the refractory system to failure at mortar joints during operation of the electrolysis cell is also significantly reduced. Moreover, because the modules are precast and predried, i.e., prefired, rather than field cast and dried at the location of the electrolysis cell installation, water removal is improved and can be achieved without cracking. The field curing problems of the prior art can be avoided and the undesirable MgO formation during cell operation owing to residual moisture in the refractory lining is substantially reduced or eliminated.

The modules have interlocking configurations at their adjacent surfaces. The interlocking surface configuration between adjacent module surfaces reduces the amount of mortar which is necessary for assembling the modules, and therefore further reduces the susceptibility of the electrolysis cell to mortar failure at the joint areas.

Figure 3:
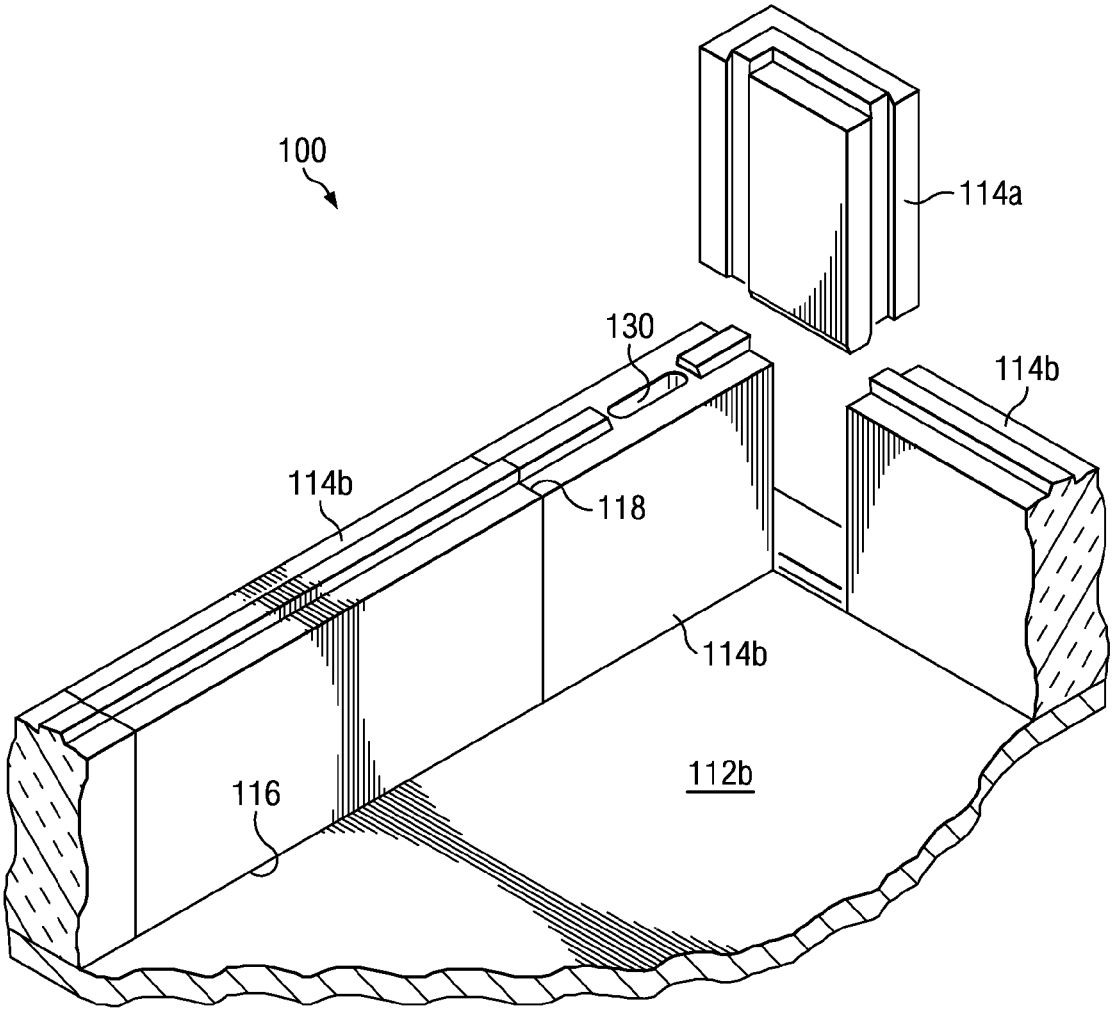
FIG. 3 shows a schematic view of one embodiment of an interlocking construction for adjacent wall module surfaces according to the present invention.
Figure 3A:
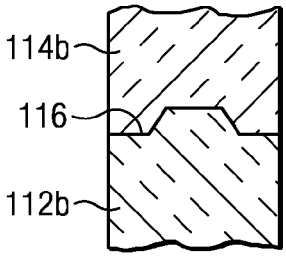
FIG. 3A shows one embodiment of the interlocking surface configuration of adjacent floor and wall module surfaces taken along line A-A in FIG. 2.
Figure 3B:
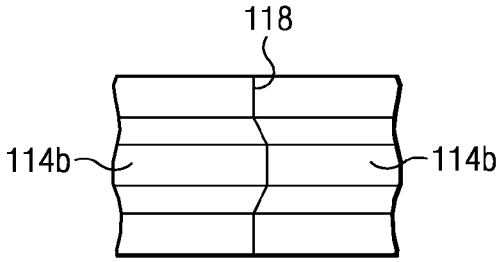
FIG. 3B shows a top view of one embodiment of the interlocking surface configuration of adjacent wall module surfaces.

FIGS. 2, 3, 3A and 3B show embodiments of an interlocking construction for adjacent wall and flooring module surfaces. For purposes of illustration, the refractory system 100 is shown as arranged on a steel containment floor panel 110 while walls of the steel containment shell are not shown. The refractory system 100 comprises flooring modules 112, shown specifically at 112*a* and 112*b*. The flooring modules are shown with ship lap interlocking surfaces at their interface 113 but one skilled in the art will appreciate that other interlocking construction configurations may be employed. Wall modules 114, shown specifically at 114*a* and 114*b*, are provided with interlocking surfaces at their lower ends which interlock with the adjacent top surfaces of flooring modules 112*a* and 112*b* at their interfaces 116, an example of which is shown in FIG. 3A, representing a view taken along line A-A in FIG. 2. FIG. 3A shows one suitable interlocking configuration but one skilled in the art will appreciate that other interlocking construction configurations may be employed. The interlocking surfaces of adjacent wall modules 114 may have a similar configuration at their interface 118, as shown in the top view of FIG. 3B, but one skilled in the art will appreciate that other interlocking construction configurations may be employed. The wall modules, and optionally flooring modules, may be provided with openings 130 for receiving vertically extending stabilizing pillars or columns (not shown), if desired.

The modules may be formed of any suitable refractory material, including, but not limited to, low cement, ultra low cement and cement-free monolithic castables. To those skilled in the art, the alumina content of the material is selected based upon the maximum corrosion resistance required in each of the zone in the electrolysis cell. For example, in one specific embodiment, lower alumina products containing about 45-70% by weight alumina are employed for the cell flooring modules and lower wall modules, and higher alumina products containing about 90-95% by weight alumina are employed in upper wall modules adjacent the salt-chlorine gas interface.

In one embodiment, the method for assembling a high temperature electrolysis cell comprises (a) providing a steel containment shell, (b) installing a floor of at least one precast and predried monolithic refractory flooring module in the steel containment shell, (c) installing precast and predried monolithic refractory wall modules in the steel containment shell, and (d) installing at least one precast and predried monolithic refractory ceiling module in the steel containment shell. Adjacent modules have interlocking surfaces and the flooring modules, wall modules and ceiling modules form a sealable electrolysis cell. The steel containment shell may be a new shell, for installation of a new electrolysis cell, or may be an existing shell, previously used, wherein the refractory system is used to rebuild the interior heat-resistant lining of the cell.

In a specific embodiment of the methods of the invention, dry vibratable refractory is also employed in the assembly of the electrolysis cell. Dry vibratable refractory materials are disclosed in the Doza et al U.S. Pat. Nos. 6,458,732 and 6,893,992, both of which are incorporated herein by reference. The dry vibratable refractory is a dry powder composition and can be employed to fill gaps between a module and the adjacent steel shell. For example, dry vibratable refractory may be installed under floor module(s) and/or between the wall modules and the steel shell.

The dry vibratable refractory sintering properties may be tailored such that a zone of the dry vibratable refractory which is furthest from the heat source, i.e., the molten salt, can still be well compacted to full density but unsintered, while the dry vibratable refractory which is closer to the reaction zone near the heat source (or leak) is sintered to a solid mass, preventing penetration of the molten salt to the steel containment shell. The dry vibratable refractory avoids addition of water to the system, and therefore avoids a drying step, and by specifically designing the sintering profile of the dry vibratable refractory, the dry vibratable refractory also allows for easier removal of the spent lining during the next repair or replacement requiring removal of the cell refractory. That is, if the dry vibratable refractory adjacent the steel shell has not been sintered, it remains in powder form and allows easier tear out of the components upon rebuild, without shell damage, and selective top of cell repairs with re-backfill and compaction of the dry vibratable. Tear out of damaged refractory systems in convention cells often deforms and warps the steel containment structure, resulting in divots and buckles. Installing modules without a flush wall will leave gaps behind the brick, which, as noted, can result in the refractory lining shifting during operation, resulting in the formation of cracks into which electrolyte can infiltrate. The dry vibratable refractory can therefore provide a solution to both leak containment and irregularities in the steel shell walls. An additional advantage of using dry vibratable refractory is the reduction in installation time compared to installation of secondary layers of brick. Bags can be opened, emptied into the space between the steel shell, for example, in bulk up to 3600 pounds at a time, if necessary, and compacted at a fraction of the time for assembling a brick wall.

The dry vibratable refractory may comprise an insulating dry vibratable material or a dense vibratable refractory material. Specific examples include, but are not limited to, chamotte, sintered mullite, fused mullite, lightweight mullite, bauxite, and andalusite, along with the materials disclosed by Doza et al, U.S. Pat. Nos. 6,458,732 and 6,893,992, noted above. In a specific embodiment, the dry vibratable material has a sufficient bonding property to sinter to a solid mass when exposed to molten salt. In a more specific embodiment, the dry vibratable material contains about 45-70% by weight alumina.

In specific embodiments, dry vibratable refractory floor material may be provided under the at least one precast and predried monolithic refractory flooring module. In another embodiment, dry vibratable refractory material is installed between the wall modules and the walls of the steel shell. In a more specific embodiment, the wall modules comprise lower wall modules which have surfaces adjacent to and interlocking with the floor module(s) and upper wall modules which have surfaces adjacent to and interlocking with the lower wall modules. Dry vibratable refractory material may be installed between the lower wall modules and the wall of the steel containment shell, after which the upper wall modules are installed, and dry vibratable refractory material is installed between the upper wall modules and the wall of the steel containment shell.

In further embodiments, a microporous, mica-covered insulating layer may be provided adjacent to the steel containment shell, arranged between the steel shell and modules, or, in an embodiment where dry vibratable refractory material is employed, between the steel shell and the dry vibratable refractory. The use of a microporous insulation board, covered in a mica sheet, reduces the effects of the salt vapor on the inside of the steel shell. The microporous board-mica combination creates an impervious layer that reduces, if not stops, the potential for electrolyte vapor to migrate and corrode the shell, reducing shell repairs related to corrosion. Additionally, the microporous board-mica combination provides a thermal barrier which reduces heat loss. One suitable material which is commercially available is Elmtherm 1000 MP from Elmelin Ltd, London, England, in which the microporous board is formed of $SiO_2$, SiC and CaO. One skilled in the art will appreciate that microporous boards of other heat-resistant and corrosion resistant materials may be employed as well.

In specific embodiments, a microporous, mica-covered insulating floor layer is provided and the dry vibratable refractory floor material is installed on the microporous, micacovered insulating floor layer. In another embodiment, a microporous, mica-covered insulating layer is provided between the steel shell walls and the dry vibratable refractory material adjacent the wall modules and/or between the ceiling module(s) and the steel shell ceiling.

In a more specific embodiment of the present methods, an electrolysis cell is assembled by (a) providing a steel containment shell, (b) installing a microporous, mica-covered insulating floor layer in the steel containment shell, installing dry vibratable refractory floor material on the insulating floor layer, and installing a floor of at least one precast and predried monolithic refractory flooring module on the dry vibratable refractory floor material, (c) installing a microporous, mica-covered insulating wall layer adjacent to the walls of the steel containment shell, installing precast and predried monolithic refractory wall modules in the steel containment shell, and installing dry vibratable refractory material between the wall modules and the microporous, mica-covered insulating wall layer, and (d) installing at least one precast and predried monolithic refractory ceiling module in the steel containment shell, wherein adjacent modules have interlocking surfaces and wherein the flooring modules, wall modules and ceiling modules form a sealable electrolysis cell.

Figure 4:
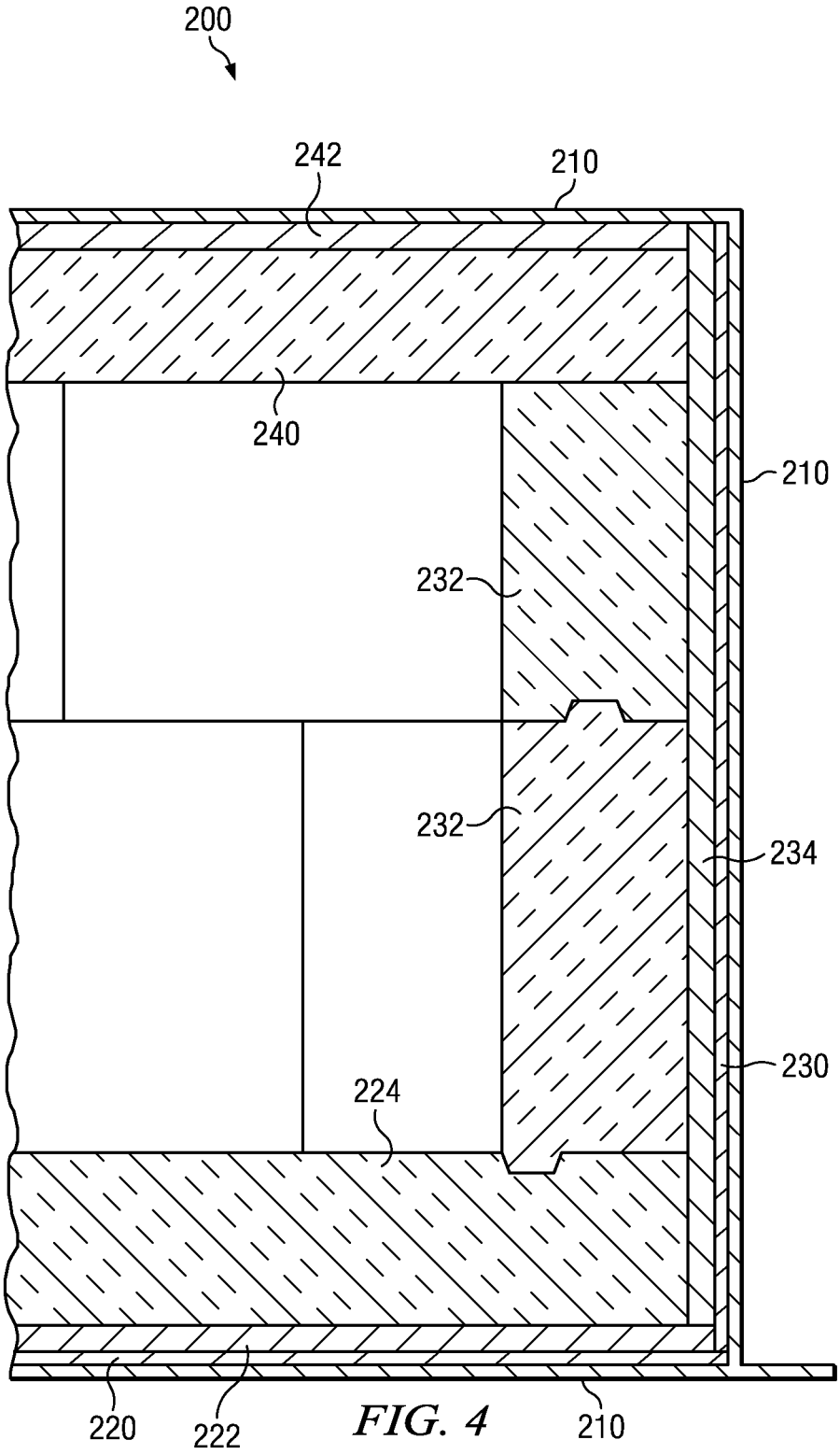
FIG. 4 shows a schematic view of one embodiment of a cross section of a wall of an electrolysis cell according to the invention.

In one embodiment, the high temperature electrolysis cell comprises (a) a steel containment shell, (b) a floor of at least one precast and predried monolithic refractory flooring module arranged in the steel containment shell, (c) precast and predried monolithic refractory wall modules arranged in the steel containment shell, and (d) at least one precast and predried monolithic refractory ceiling module arranged in the steel containment shell, wherein adjacent modules have interlocking surfaces, and wherein the flooring modules, wall modules and ceiling modules form a sealable electrolysis cell. In a more specific embodiment, and with reference to FIG. 4, a high temperature electrolysis cell 200 comprises (a) a steel containment shell 210, (b) a floor arranged in the steel containment shell and comprising a microporous, mica-covered insulating floor layer 220, dry vibratable refractory floor material 222 on the insulating floor layer, and at least one precast and predried monolithic refractory flooring module 224 arranged in the steel containment shell, (c) walls arranged in the steel containment shell and comprising a microporous, mica-covered insulating wall layer 230 adjacent to the walls of the steel containment shell, precast and predried monolithic refractory wall modules 232, and dry vibratable refractory material 234 between the wall modules and the microporous, mica-covered insulating wall layer, and (d) at least one precast and predried monolithic refractory ceiling module 240 arranged in the steel containment shell, wherein adjacent modules have interlocking surfaces, and wherein the flooring modules, wall modules and ceiling modules form a sealable electrolysis cell. A microporous, mica-covered insulating ceiling layer 242 may optionally be employed.

Remaining elements for operation of an electrolysis cell may be provided as necessary, depending on the construction of a new cell, or rebuilding of the refractory lining of an existing cell, including, without limitation, the elements shown in the conventional cell of FIG. 1. Anodes, cathodes, pillars and a partition wall are installed as required, typically moving up the structure. In one embodiment, the partition wall is formed of precast and predried wall modules as well.

Various advantages of the refractory systems, methods and electrolysis cells of the invention have been discussed throughout the disclosure. Importantly, the refractory systems eliminate a majority of water that has been employed in conventional high temperature electrolysis cell refractory systems as precast modules are prefired to remove all free and chemically combined water before installation in the cell construction and the dry vibratable refractory is moisture free. The lack of water allows for more rapid turn-around to assemble an electrolysis cell and start on line operation of the cell and provides more consistent quality metal from the cell. Additionally, the modules allow easier assembly of the electrolysis cell as the labor intensive building of a refractory lining using bricks and blocks is avoided and the number of mortar joints is highly reduced. Further, the dry vibratable refractory reduces or eliminates penetration of molten salt electrolyte beyond the first row of the modules and allows for easy use of warped shells. Advantageously, the electrolysis cells are built from centerline out to the shell walls, and demolition of a cell during a rebuild operation is substantially easier with dry vibratable than with an all brick lining. Addition of a microporous mica-covered material layer also provides thermal insulation and an impervious layer to reduce, if not stop shell corrosion.

The various embodiments set forth herein are illustrative in nature only and are not to be taken as limiting the scope of the invention defined by the following claims. Additional specific embodiments and advantages of the present invention will be apparent from the present disclosure and are within the scope of the claimed invention.

What is claimed is:

1. A high temperature electrolysis cell, comprising a refractory system including at least one precast and predried monolithic refractory flooring module, precast and predried monolithic refractory wall modules, and at least one precast and predried monolithic refractory ceiling module, wherein the at least one flooring module, wall modules and the at least one ceiling module are configured for assembly to form a sealable electrolysis cell in which the at least one flooring module and wall modules adjacent said at least one flooring module have interlocking surfaces and wall modules adjacent to one another have interlocking surfaces;

said system electrolysis cell further comprising a steel shell surrounding said refractory system.

2. The high temperature electrolysis cell of claim 1, wherein one or more modules of the at least one flooring module, wall modules or the at least one ceiling module are configured to provide the electrolysis cell with openings for receiving cathodes and/or anodes.

3. The high temperature electrolysis cell of claim 1, wherein the modules are formed of a refractory material comprising low cement, ultra low cement or cement-free monolithic castable.

4. The high temperature electrolysis cell of claim 1, comprising from two to four flooring modules, wherein floor modules adjacent to one another have interlocking surfaces.

5. A method for assembling a high temperature electrolysis cell, comprising:

(a) providing a steel containment shell, (b) installing a floor of at least one precast and predried monolithic refractory flooring module in the steel containment shell, (c) installing precast and predried monolithic refractory wall modules in the steel containment shell, and (d) installing at least one precast and predried monolithic refractory ceiling module in the steel containment shell, wherein the at least one flooring module and the wall modules adjacent said at least one flooring module have interlocking surfaces and wall modules adjacent to one another have interlocking surfaces and wherein the at least one flooring module, wall modules and the at least one ceiling module form a sealable electrolysis cell.

6. The method of claim 5, further comprising the step of installing dry vibratable refractory floor material on which the at least one precast and predried monolithic refractory flooring module is installed.

7. The method of claim 6, further comprising the step of installing dry vibratable refractory material between the wall modules and walls of the steel containment shell.

8. The method of claim 7, further comprising the step of installing a microporous, mica-covered insulating layer adjacent to the walls of the steel containment shell, wherein the dry vibratable refractory material is installed between the wall modules and the microporous, mica-covered insulating layer.

9. The method of claim 6, further comprising the step of installing a microporous, mica-covered insulating layer on which the dry vibratable refractory floor material is installed.

10. The method of claim 5, wherein the wall modules comprise lower wall modules which have surfaces adjacent to and interlocking with the at least one floor module and upper wall modules which have surfaces adjacent to and interlocking with the lower wall modules.

11. The method of claim 10, wherein the lower wall modules are installed, dry vibratable refractory material is installed between the lower wall modules and walls of the steel containment shell, the upper wall modules are installed, and dry vibratable refractory material is installed between the upper wall modules and walls of the steel containment shell.

12. The method of claim 5, wherein at least one cathode is installed in an opening formed in one or more of the modules.

13. The method of claim 5,further comprising the steps of installing a microporous, mica-covered insulating floor layer in the steel containment shell, and installing dry vibratable refractory floor material on the insulating floor layer wherein said at least one precast and predried monolithic refractory flooring module is installed on the dry vibratable refractory floor material, and installing a microporous, mica-covered insulating wall layer adjacent to the walls of the steel containment shell, and installing dry vibratable refractory material between the wall modules and the microporous, mica-covered insulating wall layer.

14. A high temperature electrolysis cell, comprising (a) a steel containment shell, (b) a floor of at least one precast and predried monolithic refractory flooring module arranged in the steel containment shell, (c) precast and predried monolithic refractory wall modules arranged in the steel containment shell, and (d) at least one precast and predried monolithic refractory ceiling module arranged in the steel containment shell, wherein the at least one flooring module and the wall modules adjacent said at least one flooring module have interlocking surfaces and wall modules adjacent to one another have interlocking surfaces, and wherein the at least one flooring module, wall modules and the at least one ceiling module form a sealable electrolysis cell.

15. The high temperature electrolysis cell of claim 14:

wherein the floor further comprises a microporous, mica-covered insulating floor layer, and dry vibratable refractory floor material on the insulating floor layer beneath said at least one precast and predried monolithic refractory flooring module, and further comprising a microporous, mica-covered insulating wall layer adjacent to the walls of the steel containment shell, and dry vibratable refractory material between the wall modules and the microporous, mica-covered insulating wall layer.

16. The high temperature electrolysis cell of claim 1, wherein the at least one ceiling module and wall modules adjacent said at least one ceiling module have interlocking surfaces.

17. The high temperature electrolysis cell of claim 3, wherein said at least one flooring module and a first portion of said wall modules are formed of a first refractory material having a first alumina content, and a second portion of said wall modules are formed of a second refractory material having a second alumina content which is greater than said first alumina content.

18. The method of claim 5, wherein said at least one flooring module and a first portion of said wall modules are formed of a first refractory material having a first alumina content, and a second portion of said wall modules are formed of a second refractory material having a second alumina content which is greater than said first alumina content.

19. The high temperature electrolysis cell of claim 14, wherein said at least one flooring module and a first portion of said wall modules are formed of a first refractory material having a first alumina content, and a second portion of said wall modules are formed of a second refractory material having a second alumina content which is greater than said first alumina content.

20. The high temperature electrolysis cell of claim 19, wherein said first alumina content is about 45-70% by weight.

* * * * *